United States Patent [19]

Schulte et al.

[11] 4,383,874

[45] May 17, 1983

[54] PYROTECHNIC COMPOSITION FOR DELAY ELEMENTS

[75] Inventors: Hans Schulte, Siegburg; Christoph Voges, St. Augustin, both of Fed. Rep. of Germany

[73] Assignee: Dynamit Nobel Aktiengesellschaft, Troisdorf, Fed. Rep. of Germany

[21] Appl. No.: 238,787

[22] Filed: Feb. 27, 1981

[30] Foreign Application Priority Data

Mar. 1, 1980 [DE] Fed. Rep. of Germany ..... 3008001

[51] Int. Cl.[3] ..... C06B 45/02

[52] U.S. Cl. ..... 149/21; 149/37; 149/110; 149/108.6; 149/114

[58] Field of Search ..... 149/37, 21, 110, 114, 149/108.6

[56] References Cited

U.S. PATENT DOCUMENTS 2,105,674 1/1938 Sosson ..... 149/37

*Primary Examiner*—Stephen J. Lechert, Jr.

*Attorney, Agent, or Firm*—Sprung, Horn, Kramer & Woods

[57] ABSTRACT

A pyrotechnical composition for delay elements comprising metallic antimony and potassium permanganate are disclosed. The pyrotechnical composition can contain 0.1 to 2.08 percent of a light metal in powder form. It is useful as a delay composition in time fuses having burning time intervals of over 150 milliseconds.

9 Claims, No Drawings

PYROTECHNIC COMPOSITION FOR DELAY ELEMENTS

BACKGROUND OF THE INVENTION

The object of the present invention is a pyrotechnic composition for delay elements incorporated in time fuses, for example, which is based on metallic antimony and potassium permanganate. The composition is used mainly in time fuses which are to have delay intervals of 150 milliseconds (ms) and up.

As is known, time fuses are used where explosive charges are to be detonated successively, at predetermined defined time intervals, by a single ignition. The time interval from the start of initiation of ignition to detonation of the time fuse is termed delay time.

To secure optimum effectiveness of time fuses, the delay time must be maintained as accurately as possible. The unavoidable variation in delay time must be so small that the burning time of a given time stage is not shorter than the longest burning time of the next-lower time stage and not longer than the shortest burning time of the next-higher time stage. This means that there must be no overlapping of the burning times of adjacent time stages.

The difference between the delay times of adjacent time stages of time fuses is known as delay interval. Thus, time fuses having delay intervals of 500 ms in time stage 3 should detonate 1500 ms after initiation of ignition, and those of time stage 4 should detonate 2000 ms after initiation of ignition.

It is further known to use mixtures of metallic antimony and potassium permanganate in delay compositions with time intervals of one-half second and up. However, there is so much variation in these compositions that they result in overlapping in the interval range below 500 ms.

Thus, there has been a need for pyrotechnic composition which has so little burning-time variation even with delay intervals of 150 ms and up that no overlapping occurs when it is used in time fuses.

SUMMARY OF THE INVENTION

In seeking to fill this need, it has been found that by adding light metals such as silicon to the mixture of metallic antimony and potassium permanganate, the variation in delay time of time fuses made with this delay composition can be considerably reduced. The composition in accordance with the invention is characterized in that with a weight ratio of antimony to potassium permanganate of (33–45):(55–65) it contains in addition from 0.1 to 2.0 weight percent of at least one light metal in powder form.

Generally speaking, the pyrotechnical composition of this invention comprise the following components in the amounts specified.

| | WEIGHT PERCENT | |
|---|---|---|
| COMPONENTS | BROAD RANGE | PREFERRED RANGE |
| Antimony | 33 to 45 | 38 to 42 |
| Potassium permanganate | 65 to 55 | 61 to 57 |
| Light Metal e.g. silicon | 0,1 to 2,0 | 0,5 to 1,8 |

These compositions in accordance with the invention permit time fuses with delay intervals of 150 ms and up to be produced that will detonate without overlapping.

The pyrotechnic composition preferably contains powdered silicon in addition to antimony and potassium permanganate. The amount of silicon, or of other light metal also suited for use, is always based on the entire composition.

The pyrotechnic compositions in accordance with the invention have at all times very constant burning times. When a composition in accordance with the invention is pressed into a shell having a diameter of about 3.3 mm with a plunger pressure beween 800 and 1400 bar, this composition burns completely in 250 ms if the shell is filled to a height of about 2.5 mm with it. A multiple of this filling height provides a like multiple of burning time. In this way, more time stages are obtained than with prior-art half-second fuses.

In the composition in accordance with the invention, the ratio between antimony and potassium permanganate can range from 1:1.2 to 1:1.85. The amount to be used in each case depends on the average particle size of the individual substances. As a general rule, a reduction in the particle size of a substance results in a reduction in the burning time of the composition. Thus, the particle size of the antimony can be below the 100μ level and preferably is less than 60μ. The potassium permanganate is used in particle sizes smaller than 60μ.

The amount of light metal in the composition in accordance with the invention ranges from 0.1 to 2 weight percent. It is preferably used in amounts between 0.5 and 1.8 weight percent. Its particle size should likewise be under 100μ and preferably under 60μ. For the purposes of the invention, light metal means primarily aluminum, magnesium and silicon as well as alloys of these metals. The preferred light metal is silicon.

The individual components should be distributed in the composition of the invention as uniformly as possible. The components should, therefore, be vigorously and intimately mixed in suitable known equipment and brought to a free-flowing condition.

The compositions in accordance with the invention are preferably used as delay compositions in the quarter-second range. In order that they may incorporate this delay interval, they are pressed into the shells of the delay compositions with a plunger pressure of from 800 to 1400 bar. In this way, the shells are packed with the composition according to the diameter of the shells and the desired burning-time stage.

These delay compositions can then be used in known manner in time fuses or other delay devices.

EXAMPLE

400 Parts by weight of antimony of a particle size under 60μ were intimately mixed with 590 parts by weight of finely ground potassium permanganate (particle size under 60μ) and 10 parts by weight of silicon powder (particle size under 60μ). Several shells 3.3 mm in diameter were then filled with this mixture with a plunger pressure of 1100 bar to a height of 2.5 mm or whole multiples thereof.

When ignited in time fuses, the delay compositions produced in this manner resulted in no overlapping of the burning times of the individual time stages. The burning times were determined by means of known electronic measuring instruments.

We claim:

1. In a pyrotechnical composition for a delay element comprising metallic antimony and potassium permanganate, the improvement wherein the weight ratio of antimony to potassium permanganate is (33–45):(55–65) and said composition contains 0.1 to 2.0 weight percent of a light metal selected from the group consisting of silicon, aluminum, magnesium and alloys containing at least one of said silicon, aluminum and magnesium.

2. A pyrotechnical composition according to claim 1, wherein said light metal is silicon.

3. A pyrotechnical composition according to claim 1, wherein the ratio between antimony and potassium permanganate can range from 1:1.2 to 1:1.85.

4. A pyrotechnical composition according to claim 1, wherein the antimony is present in a particle size below 100μ.

5. A pyrotechnical composition according to claim 4, wherein the potassium permanganate is present in a particle size smaller than 60μ.

6. A time delay fuse comprising the pyrotechnical composition of claim 1.

7. A time delay fuse according to claim 6, wherein said fuse has a burning time interval of over 150 milliseconds.

8. A pyrotechnical composition according to claim 1, wherein said light metal has a particle size of under 100μ.

9. A pyrotechnical composition according to claim 1, wherein said light metal is present in a particle size of under 60μ.

* * * * *